US008088006B2

(12) United States Patent
Neff

(10) Patent No.: US 8,088,006 B2
(45) Date of Patent: Jan. 3, 2012

(54) CARD GAME SYSTEM AND METHOD

(76) Inventor: Gregor N. Neff, Dobbs Ferry, NY (US)

( * ) Notice: Subject to any disclaimer, the term of this patent is extended or adjusted under 35 U.S.C. 154(b) by 1339 days.

(21) Appl. No.: 11/157,560

(22) Filed: Jun. 21, 2005

(65) Prior Publication Data

US 2006/0183524 A1 Aug. 17, 2006

Related U.S. Application Data

(60) Provisional application No. 60/652,471, filed on Feb. 11, 2005.

(51) Int. Cl.
*A63F 9/24* (2006.01)

(52) U.S. Cl. ..... 463/42; 463/30; 273/148 B; 273/309

(58) Field of Classification Search ..... 463/30–40, 463/42; 273/434–39, 148 B, 309
See application file for complete search history.

(56) References Cited

U.S. PATENT DOCUMENTS

| | | | | |
|---|---|---|---|---|
| 3,044,693 | A | 7/1962 | Flam | |
| 3,364,339 | A | 1/1968 | Flam | |
| 3,420,526 | A * | 1/1969 | Berger | 273/148 R |
| 4,130,871 | A | 12/1978 | Olsen et al. | |
| 4,245,216 | A | 1/1981 | Rintoul | |
| 4,305,563 | A * | 12/1981 | Presson | 248/349.1 |
| 4,856,787 | A | 8/1989 | Itkis | |
| 5,240,249 | A | 8/1993 | Czarnecki et al. | |
| 5,743,797 | A | 4/1998 | Jannersten | |
| 5,931,763 | A | 8/1999 | Alessandri | |
| 5,941,769 | A | 8/1999 | Order | |
| 6,597,384 | B1 * | 7/2003 | Harrison | 345/204 |
| 2001/0031657 | A1 | 10/2001 | White | |
| 2003/0064805 | A1 * | 4/2003 | Wells | 463/39 |
| 2003/0137110 | A1 | 7/2003 | Huard et al. | |
| 2004/0082371 | A1 | 4/2004 | Terlizzi | |
| 2005/0043088 | A1 * | 2/2005 | Nguyen et al. | 463/29 |
| 2006/0014586 | A1 * | 1/2006 | Gatto et al. | 463/46 |

FOREIGN PATENT DOCUMENTS

| | | |
|---|---|---|
| EP | 380449 | 1/1990 |
| EP | 745411 | 5/1996 |
| FR | 2502815 | 3/1981 |

(Continued)

OTHER PUBLICATIONS

MVP Bridge for Windows v. 3.7, © 1994-1998 Cascoly Software, pp. 1-5, http://www.mvpsoft.com.*

(Continued)

*Primary Examiner* — Peter DungBa Vo
*Assistant Examiner* — Steve Rowland

(57) ABSTRACT

The card playing system or network and method is particularly suitable for playing bridge and other multi-table card games in clubs and tournaments. A remote input/output device or scoring unit is provided at each of a plurality of tables. Each remote unit preferably has a transmitter and receiver for sending and receiving playing information to and from a base station, such as a base computer and/or a connection to the World Wide Web. The base station equipment also has a transmitter and receiver. Bids are input into the scoring units by operating keys or other input means, and the bids and scores are transmitted by means of the network to the base station. The base computer or website equipment computes interim standings of the players and sends that and other information to the scoring units. Transmission preferably is wireless or by means of cables.

16 Claims, 8 Drawing Sheets

FOREIGN PATENT DOCUMENTS

| | | | |
|---|---|---|---|
| FR | 2534481 | | 10/1982 |
| GB | 2338188 | A | 6/1998 |
| GE | 27 08 744 | | 3/1977 |
| WO | WO2004/014503 | | 8/2002 |

OTHER PUBLICATIONS

Bridge Baron, copyright 2003-2007.
Abstract and translation of EP0380449 of 1990.

* cited by examiner

Fig.3.
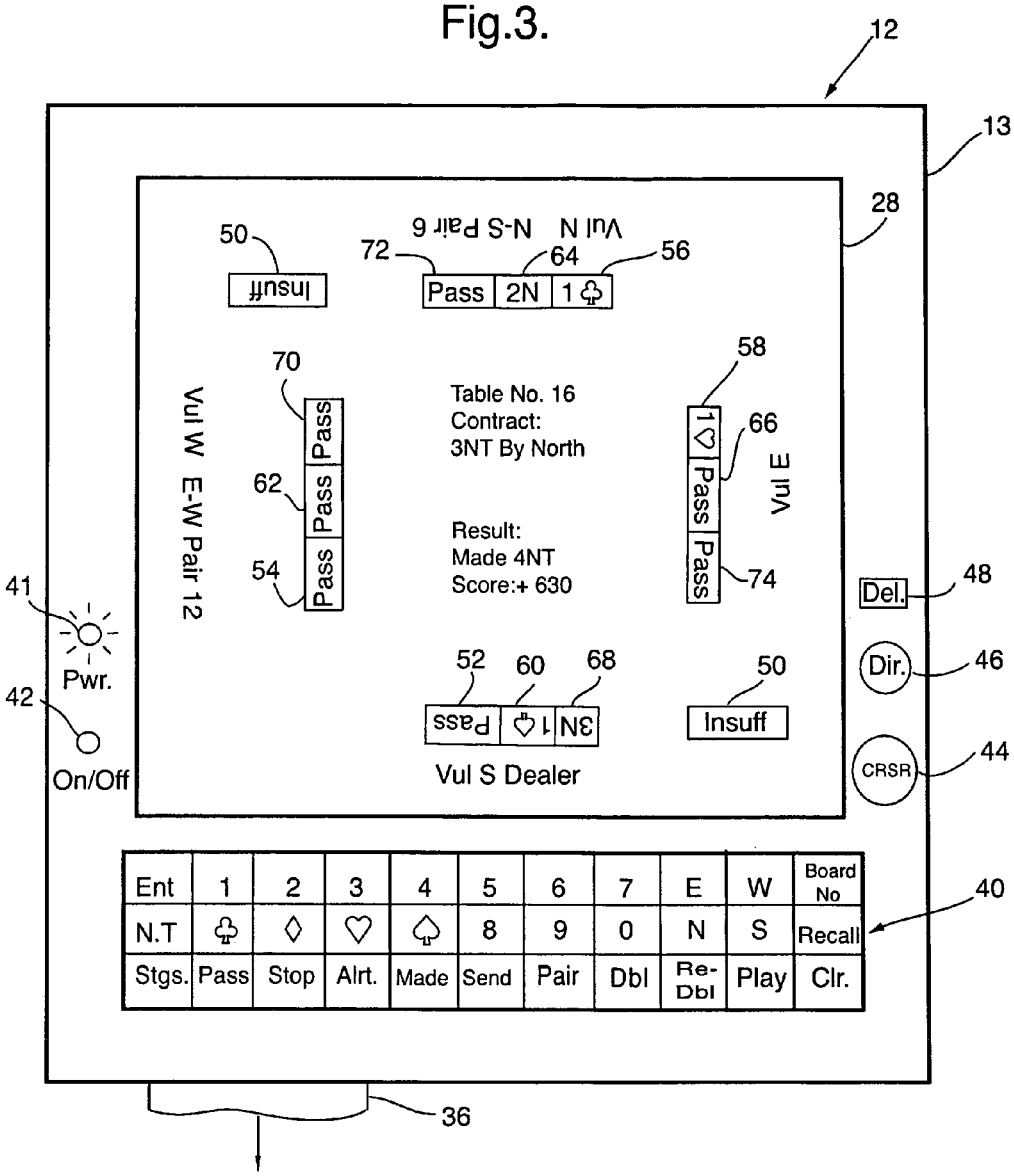
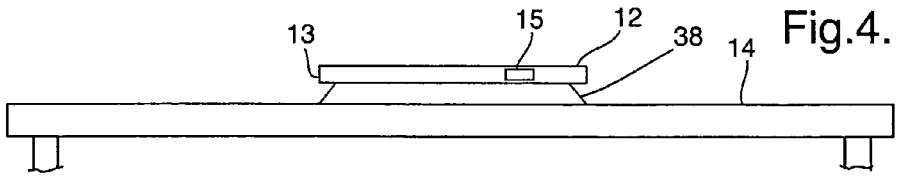
Fig.4.

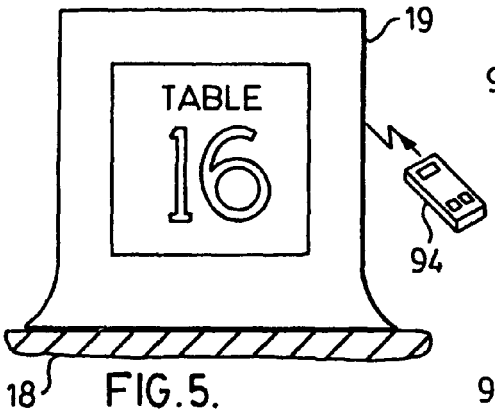
FIG.5.
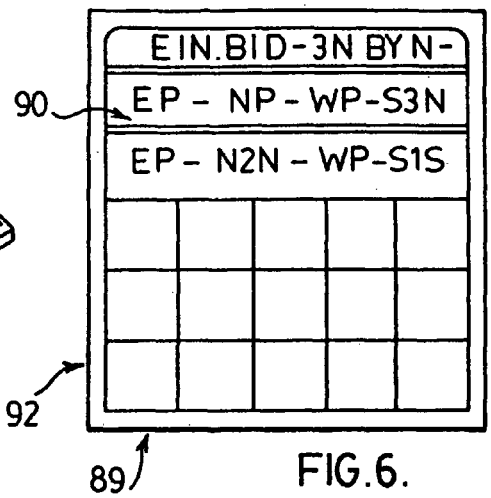
FIG.6.
FIG.7.
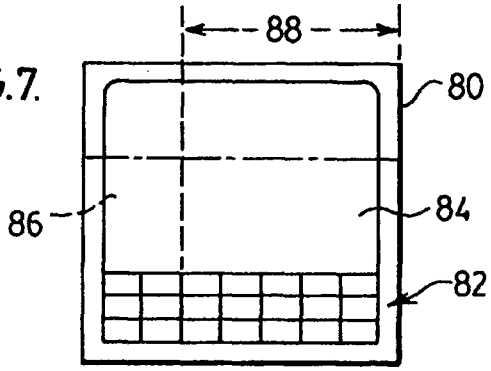
FIG.8B.
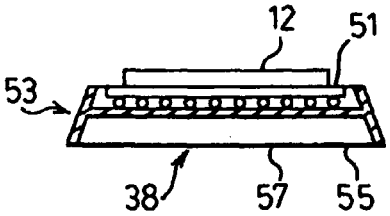
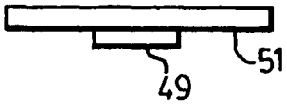
FIG.8A.
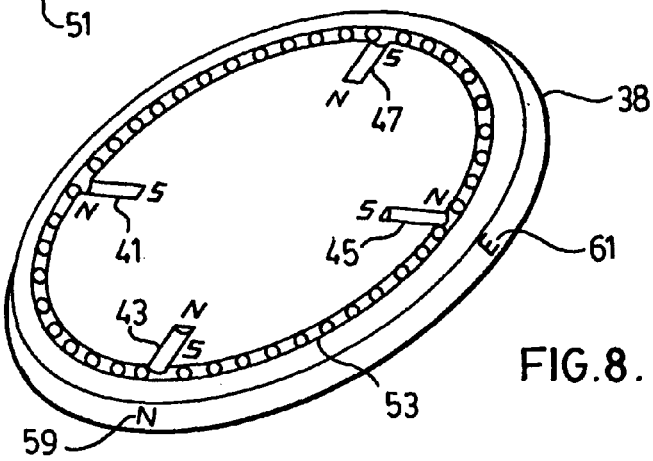
FIG.8.

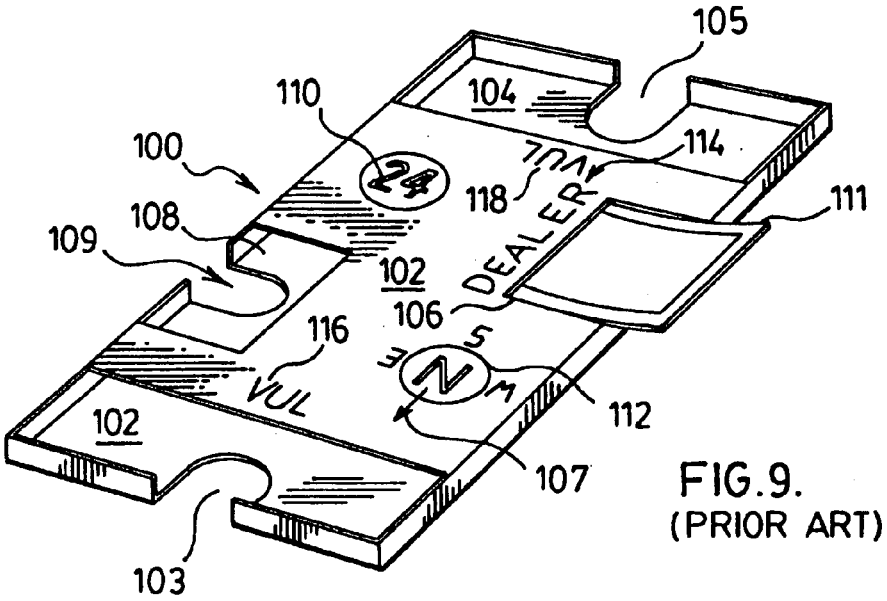
FIG.9.
(PRIOR ART)
FIG.10.
(PRIOR ART)
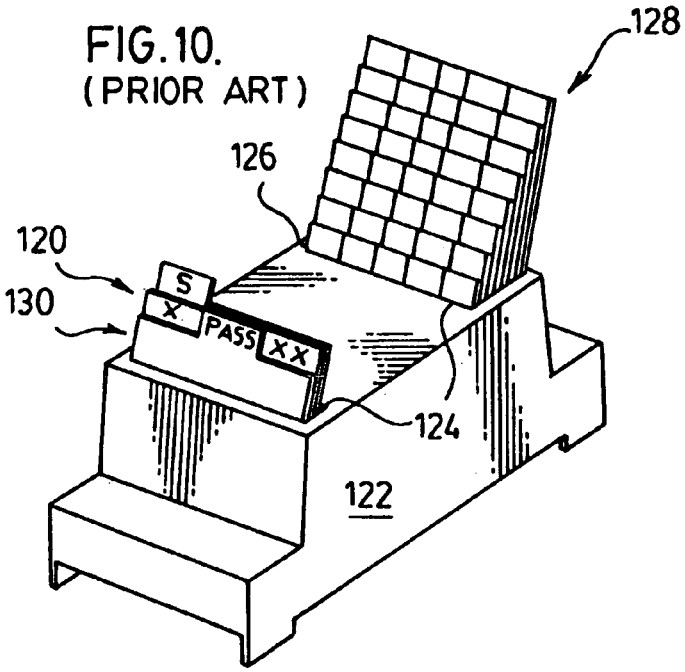
FIG.11.
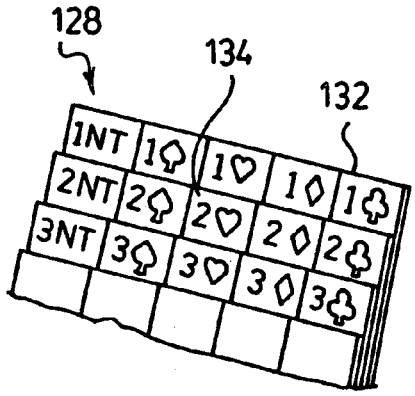

FIG. 19.
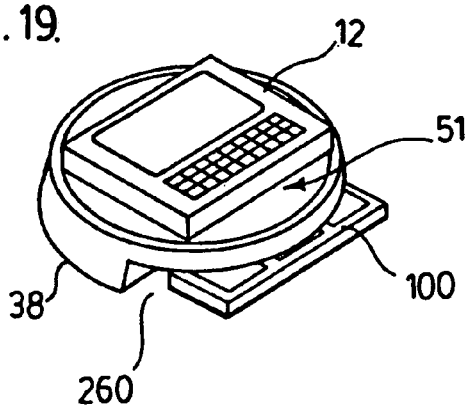
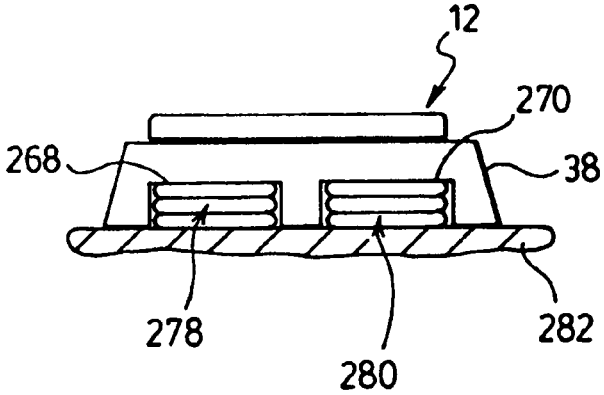
FIG. 20.

CARD GAME SYSTEM AND METHOD

Priority for this patent application is claimed from U.S. provisional patent application Ser. No. 60/652,471, filed Feb. 11, 2005.

FIELD OF THE INVENTION

This invention relates to card game systems and methods, and particularly to bridge playing systems and methods.

BACKGROUND OF THE INVENTION

In the normal play of competitive bridge, in clubs and tournaments, the players typically use "bidding boxes" (see FIGS. 10 and 11) with bidding cards having large, printed bids on them. For example, there is one card for each of the seven possible bids in each of four suits, and in no-trump. There normally are additional bidding cards showing "double" ("X"), "redouble" ("XX"), "ALERT" or "STOP". Those bidding cards are used to make bids during the game by laying the bidding cards on the table, in front of the bidding player. When bidding is complete, the bidding cards are returned to the bidding boxes and play proceeds.

In pairs games, each pair of players or team is given a team number, e.g., N-S 14 or E-W 9 (indicating pair No. 14, sitting North-South, and pair No. 9, sitting East-West). When the game has been played, the score, the "board" number (the number assigned to the cards played, which are held in a holder called a "board", See FIG. 9) and team number information is written on a paper score sheet.

FIG. 9 shows a typical prior art card-holder or "board" 100, in common use in playing duplicate bridge. The board 100 has a rectangular body 102, usually made of metal, forming a shallow tray with four card-holding compartments, including two end compartments 102 and 104, and two side compartments 106 and 108. Each compartment has a U-shaped cut-out area 103, 105, or 109 in the bottom wall. The cut-out area for the compartment 106 is hidden. The cut-outs allow access of a person's thumb or other finger to the under-surface of a group of playing cards, such as the group 111 contained in each of the compartments in order to remove the cards.

Each of the compartments has a depth or height just sufficient to snugly receive thirteen cards, one bridge hand, with the end compartments 102 and 104 being relatively wide to receive the cards sideways, and the side compartments being relatively narrow to receive the cards end-wise.

The cards 111 form one bridge hand partially withdrawn from the compartment 106. The other compartments are empty.

As it is well known, the board 100 is used by first aligning the board with the arrow 107 pointing towards the player sitting in the North seat, and each of the four players at a table removing the one of the hands from one of the compartments corresponding to his or her seat (N, S, E or W). Then bidding proceeds until either a contract has been reached or the hand has been "passed-out" by no-one bidding. If a contract was reached, the hand is played, with the players arraying the cards they have played along the edge of the card table in front of them, being sure not to mix the cards with those played by others, and then after the completion of play, returning the cards to the same compartments from which they came. Each board then is passed to another table to be played by other players. In "duplicate" bridge, this is repeated until all, or almost all players in the game have played each of 20 to 30 boards used in a typical game.

The board 100, or a stack of 2 to 5 boards, often sits in the middle of the card table during play. The legends 110, 112, 114, 116, 118 on the board being played thus are visible to remind the players of who is the dealer, which pair of players is "vulnerable", the number of the board, etc.

In determining the standings of the players in a "duplicate" bridge game, the score of each pair on each board is compared with the score of all other pairs which played the board in the same direction. (That is, the scores of players who sat E-W are compared with the scores of other players who sat E-W; and the scores of N-S players similarly are compared with those of other N-S players). The pair achieving the best score on a given board is awarded a certain number of victory points, and lower scores on the board are given smaller numbers of victory points. The total number of victory points for each pair is determined, and the pair with the largest total is ranked first, and pairs with lower totals are ranked in descending order.

At the end of the game, Master points are awarded to the leading players in an amount determined by the rules of Bridge, and usually vary from game to game.

As it was noted briefly above, FIG. 9 shows several permanent markings on the body 102 of the board 100.

First, the number of the board ("24", in this case) is marked in large numbers at 110.

Another marking 112 indicates which player is to receive the cards in each of the compartments by the "N", "S", "E" and "W" markings. The board 100 is placed on the card table, in the center with the arrow 107 pointing towards the north player so as to place each of the four hands facing the player who is to play it.

A further marking 114 shows which player is deemed to be the "dealer". This is needed because the cards normally are not actually dealt to start play of the board. The marking in FIG. 9 indicates that West is the dealer, and thus starts the bidding.

Finally, vulnerability or lack of it is determined by markings such as 116 and 118 on the board. The markings indicates that the N-S pair is vulnerable, but the E-W pair is not.

Although the markings on the board sometimes are permanent, in some boards they can be changed.

FIGS. 10 and 11 show a typical bidding box 120 which is now in use and which it is one object of the invention to replace.

The bidding box 120 includes a body, usually made of molded plastic, having two receptacles 124 and 126. Receptacle 126 holds an array 128 of bidding cards, and the receptacle 124 holds a group 130 of bidding function cards such as one marked "PASS"; others marked "X" or "XX" for doubling or re-doubling a bid; one marked "S" for "STOP", for use in warning of jump bids, and "ALERT" (not shown) for use in alerting opponents to the use of unusual bidding conventions.

FIG. 11 is an enlarged view of the upper portions of some of the bidding cards 128. There is a separate card for each of the 35 different bids that can be made, from 1 to 7 clubs, diamonds, hearts, spades or no-trump.

The first card 132 is at the rear of the array 128 and is marked with a 1 club symbol in the upper right-hand corner, and the other cards marked with 1-bids are cut at the top so as to expose the markings of the other cards in the same row when the cards are stacked one in front of the next. The next five cards in the row of two-bids, which is below the first row, are shorter than the cards bearing one-bids, and are cut at the top to expose each two-bid on every card behind it.

This scheme is repeated until the last row, having the shortest cards, displays the seven-bids.

In using the bidding cards, one grasps the small area of the card showing the bid to be made (e.g., the 2 hearts card 134) and all the cards behind that card, lifts them out of the bidding box, and lays them on the card table, with a large representation of the bid showing. "PASS", "X", "XX", "STOP" and "ALERT" cards also are laid on the table.

When a predetermined number (usually two to five) of boards or hands have been played at a table, then the score sheet bearing the scores for each of the games is left to be picked up by the "director" of the game, or a "caddie" or other person. The score sheets then are carried to a base computer where they are input by a person, often the director, and the computer computes the scores and the standings of players in the game, and master points to be awarded.

Meanwhile, one of the pairs (usually the East-West pair) at the table where the games were just played moves to another table, playing a different pair of boards against a different set of opponents.

At the end of the session, when each team has played all or almost all of the boards, and all of the score sheets have been submitted and the scores entered in the base computer, the final standings of the players, together with any "master points" won by the players, are posted on a printout sheet which is handed out or displayed on a bulletin board or the like for the players to determine how they did.

In certain important tournaments involving top players, the progress of the play of selected teams and games is displayed on a screen or scoreboard outside of the room in which the game is being played so that spectators can follow the action.

The foregoing system has a number of disadvantages. First, the use of bidding boxes is problematic. People with large and/or shaking fingers often have trouble grasping the right bidding card, with the result that they withdraw the wrong bid card and thus must correct the error. This wastes time and causes annoyance to all of the players, and can lead to disputes.

Moreover, the bidding boxes 120 usually are relatively large and, since there are four of them, they occupy a great deal of table space—often crowding the areas needed to spread out cards which have been played.

Further, because the bidding card array 128 is so tall, it is a ready target for a hand or elbow to accidentally knock it onto the floor. This scatters the cards and requires considerable time and effort to restore.

In addition, the bidding cards become worn, broken or torn and dirty and need cleaning and replacing fairly frequently.

The scoring system described above also has drawbacks.

First, the handwriting of the person keeping score often is difficult to read, causing delays in querying the writer for clarification.

Secondly, many mistakes are made in filling out the score sheets, including the omission of the board number or the pair number, placing the scores in the wrong columns, and computing the score wrongly.

Also, the gathering of the score sheets and the inputting of the scores to the base computer are time consuming tasks, usually falling upon the shoulders of the director. Since the director often is required to settle disputes or make rulings on wrong bids or wrong plays, the director often is overtaxed and needs the assistance of further directors and/or paid "caddies" to pick up and deliver the slips.

Although the base computer is programmed to compute scores and standings quickly, due to the inputting requirements and other duties befalling the director, interim standings information seldom is available, and usually is not made available until near the end of the game, some two or three hours after its start. This leaves the players mostly in the dark as to their standings and as to the intensity of their efforts and risk-taking needed to overcome a deficit in their previous performance. That is, they do not know whether they can come from behind to win, or are far ahead, etc.

The use in some cases of so-called "travelers" provides partial but inadequate relief for the latter problem. The "traveler" is a piece of paper on which the score of the hand is written (for a second time, if separate scoring sheets are used), and which is folded up and inserted into a gap or space in the board so that it travels with the board to the next table. After play of a hand is over, the players can look at the traveler and perhaps obtain an idea of how they did when they see scores of others who have played the hand before them.

The use of travelers is of little help early in the game because of the paucity of prior results. Even later, it still does not provide much information to the players as to where they might stand among all other players. Also, the use of travelers usually adds work and extra time to the scoring duties of the players. Because of disputes the travelers may create, their use, in addition to separate score sheets, tends to slow the play of the game and involve the director in corrections of disputes regarding the travelers. Therefore, travelers often are not used at all.

Sometimes, only travelers are used for scoring, thus minimizing the time needed by the players to record the scores, as compared with games in which both score sheets and travelers are used. However, the scores recorded on the travelers cannot be input into a computer until the last round of play, when they are replaced by separate scoring sheets. This requires extra work and limits the time available to input the scores recorded on the travelers.

Of course, the latter system prevents interim standings from being computed or disseminated to the players, and the standings usually are not known until the evening's play is ended.

Another problem lies in the summoning of the director to a table to resolve a dispute.

Normally, the summoning process requires one to shout to get the attention of the person summoned. This can distract other players and disrupt the play of the game.

Another problem in bridge duplicate games and tournaments is that the players often do not move to the correct table when it is time to move from one table to the next. This is especially true when the movement pattern necessary for the game requires a "skip"—that is, it is required for the moving pair to skip one or more table in their movements. For example, moving from table 12 to table 14, and by passing table 13, the table to which the pair would move if there were no "skip." Although directors usually announce skips frequently and prominently, still some players fail to do the skip correctly. Again, the announcements are distracting.

A further problem is in properly instructing the players as to preparatory steps they should take before play. Most of the time, the players will be required to shuffle the cards in from 2 to 5 boards, and replace the cards in the boards. Sometimes, usually for tournaments, computer-generated deals are printed on sheets, one for each board, and the players must arrange the cards in the order given on the printed sheets, and return them to the board. Then, the boards either must be passed to another table or, if the cards were shuffled by the players at the table, and in other circumstances, those players keep the boards and play them. Sometimes, one pair is then required to move to another table.

Communicating such starting instructions is haphazardous. Usually, they are given orally, either by shouting or use of a public-address system, and often are not heard correctly or at all. This requires time to cure the situation and ensure that all players know what to do.

Furthermore, printing computer-generated deals causes added expense. Also, distributing the printed sheets and retrieving them after use requires added labor cost to run a tournament.

Another problem is in providing movement schedules for players in games which require special movements. For example, whereas players in ordinary pairs duplicate games usually move from one table to the next higher-numbered table, in "Howell" movements in pairs games, or in "individual" games, the pairs or individuals are given printed schedules, prepared by an on-site computer using known software, and a printed schedule is distributed by hand to the pairs or individual players. This requires extra manual labor and expense.

In so-called "knockout" games played by teams of four or more players, scoring often is done manually, in "IMPs" (International Match Points), and this can lead to scoring errors and lack of sufficient interim standings of the teams against one another.

Similar problems exist in card games other than bridge. For example, in poker tournaments, player chip counts, bets, and sizes of pots, often are not known to the players or officials. Moreover, chip counting and handling often slow the game. Similar problems will occur in tournaments using multiple tables for playing other card games, such as "hearts", "spades", etc.

OBJECTS OF THE INVENTION

Accordingly, it is an object of the invention to provide a card playing system or network and method, specifically a bridge playing system and method, which will alleviate or eliminate the foregoing problems.

In particular, it is an object to provide such a system and method in which bidding or betting, scoring and communications with players are made simpler, more accurate, less time-consuming and less labor intensive than in the past.

SUMMARY OF THE INVENTION

In accordance with the present invention, the foregoing objects are achieved by the provision of a card playing system or network and method, and particularly a bridge playing system or network and method, in which electronic remote input/output units are provided at each playing table with means for communicating information with a base station and/or other remote units.

Input means are provided on each of the remote units to enable input of the bids made by the players, and to transmit bidding information to the base station.

Preferably, the remote units are programmed to compute the scores of each game electronically. Then, the bidding information is transmitted to a base station, such as a computer which accumulates the information and computes the standings of the players. Alternatively, a link to the World Wide Web is made for the same purpose, or each remote unit communicates with others to achieve the same purpose. The standings information is transmitted back to the remote units (sometimes called "scoring" units, for the sake of convenience) for display so that the players can determine where they stand at various times in the proceedings.

Optionally, the information normally provided on "travelers" can be accumulated at the base station and displayed on a specific remote unit upon demand from that unit, if, and only if, the board has been played by all players at the table.

The result is the elimination of the need for bidding boxes and paper scoring sheets, and, optionally, the elimination of travelers as well.

The work required to fill out, gather, and carry the score sheets to the usual base computer, and to enter the scores in the base computer, is eliminated. This frees the players from the writing task, and frees the director or other personnel for other tasks. It is even possible that a single director can direct two or more nearby games simultaneously because of the automation of the bid slip collection and entry function. The number of caddies needed can be reduced, or caddies can be eliminated, and labor costs reduced. Scoring errors can be reduced. Interim standings of the players, and, optionally, traveler's information can be obtained during the game, thus adding to the excitement and/or pleasure experienced by the players.

In accordance with another feature of the invention, the location of each moving pair of players (usually E-W) can be input for each round of play, and "skips" can be scheduled. Whenever a pair moves to a new table, it must "sign in" by inputting its pair number and transmitting it to the base station. If the number thus input does not match the number scheduled for that table, the players, or both the players at the table and the director are signaled to indicate the need for correction of the error. Thus, "skip" errors and other seating errors can be avoided or corrected promptly, before any serious damage is done.

Similarly, player movement schedules for given games, such as "Howell" and "individual" movements, can be displayed at each remote unit instead of, or in addition to, the printed paper slips usually used for the purpose.

Preparatory instructions to the players can be composed at the base computer or worldwide web server and transmitted to all of the scoring units and displayed in order to give written instructions instead of, or in addition to, oral instructions. This reduces confusion and speeds play.

In addition, computer-generated deals need not be printed, distributed, to and retrieved from the players manually. Instead, each deal is stored in the base computer and delivered to each scoring unit that is entitled to receive it, on proper demand from the scoring unit. Thus, two other manual chores and their labor costs are eliminated.

Each remote scoring unit preferably has a single keyboard for inputting bids, etc., but is easy to rotate to each of the four positions around a card table for use, in succession, by each of the players.

One means to facilitating the rotation of the scoring unit is to place it on a turntable. Another is to provide a "virtual" keyboard and display array on a touch-screen device and rotate the array.

In an optional embodiment of the invention, a space is provided under the scoring unit, preferably in the turntable, for storing from one to five boards to place them out of the way during play of a hand and whenever they are not needed.

Alternatively, a fixed scoring unit with four keyboards for individual use by the players can be provided instead. Cost and space limitations make other scoring units described above preferable.

In one embodiment using a turntable, optionally, four detents are provided for locating the scoring unit accurately at one of the four player positions and detectors are provided to input a signal identifying the position of the bidder so as to save having to input a position—identifying signal in addition to the bid signals.

Preferably, the transmission of information between the base station and the remote units is wireless. "Access points" and routers with standard or directional antennas such as those used in "Wi-Fi" networks can be used to form local area networks wirelessly linking the remote units to the base station.

In one embodiment, the remote units are connected to a remote server through the world-wide web, and the server performs some or all of the functions which otherwise would be performed by an on-site computer.

"Wired" networks, including those using fiber-optic cables, also can be used, where it is cost-effective to do so. Hybrid networks using both cables and wireless communication also are viable alternatives, in some circumstances.

In accordance with another feature of the invention, service calls to directors, waiters or waitresses or other personnel can be made from each table simply by pushing a call button on the scoring unit at that table. This sends a signal to a call light which displays the number of the table making the call.

The call light therefore silently informs the necessary personnel that service is needed at a specific table.

The call light can be extinguished by pressing the call button again and/or by the director or service personnel using remote transmitters they carry with them. The second-pressing of the call button to extinguish the light also allows the players to cancel the call before it is responded to, in case the call was in error or is no longer necessary, thus avoiding an unnecessary service trip.

The call light can be rechargeable battery-powered or it can have a power cord and plug for plugging into a convenient household AC power outlet.

Separate call buttons and lights can be provided for directors and for waiters, waitresses and other service personnel. Multiple lights at different locations can be used, if needed.

A soft, inobtrusive bell or gong sound can accompany the lighting of the call lamp.

The call light system thus enables the summoning of directors and service personnel quietly and quickly, thus adding to the enjoyment of the game by the calling players as well as the other players in the vicinity.

The foregoing and other objects and advantages of the invention will be described in or apparent from the following description and drawings.

IN THE DRAWINGS

FIG. 3 is a top plan view of one of the remote units shown in FIG. 1;

FIG. 4 is a side elevation view showing one of the remote units in use on a playing table;

FIG. 5 is a schematic view of a portion of the system shown in FIG. 1;

FIG. 6 is a top plan view of an alternative component of the FIG. 1 system;

FIG. 7 is a top plan view of another alternative component of the FIG. 1 system;

FIG. 8 is a perspective view of one embodiment of a turntable of the invention using a position-sensing detent structure;

FIG. 8A is a broken-away schematic view of a portion of the turntable of FIG. 8;

FIG. 8B is a cross-sectional front elevation view of the turntable and scoring unit of FIG. 4;

FIG. 9 is a perspective view of a typical prior art card-holding "board" used in playing competitive bridge;

FIG. 10 is a perspective view of a typical prior art bidding box used in playing competitive bridge;

FIG. 11 shows an enlarged portion of the bidding cards shown in the bidding box of FIG. 10;

FIG. 19 is a perspective view of another alternative embodiment of the remote scoring unit; and FIG. 20 is a front elevation view of another embodiment of the remote scoring unit.

GENERAL DESCRIPTION

Figure 1:
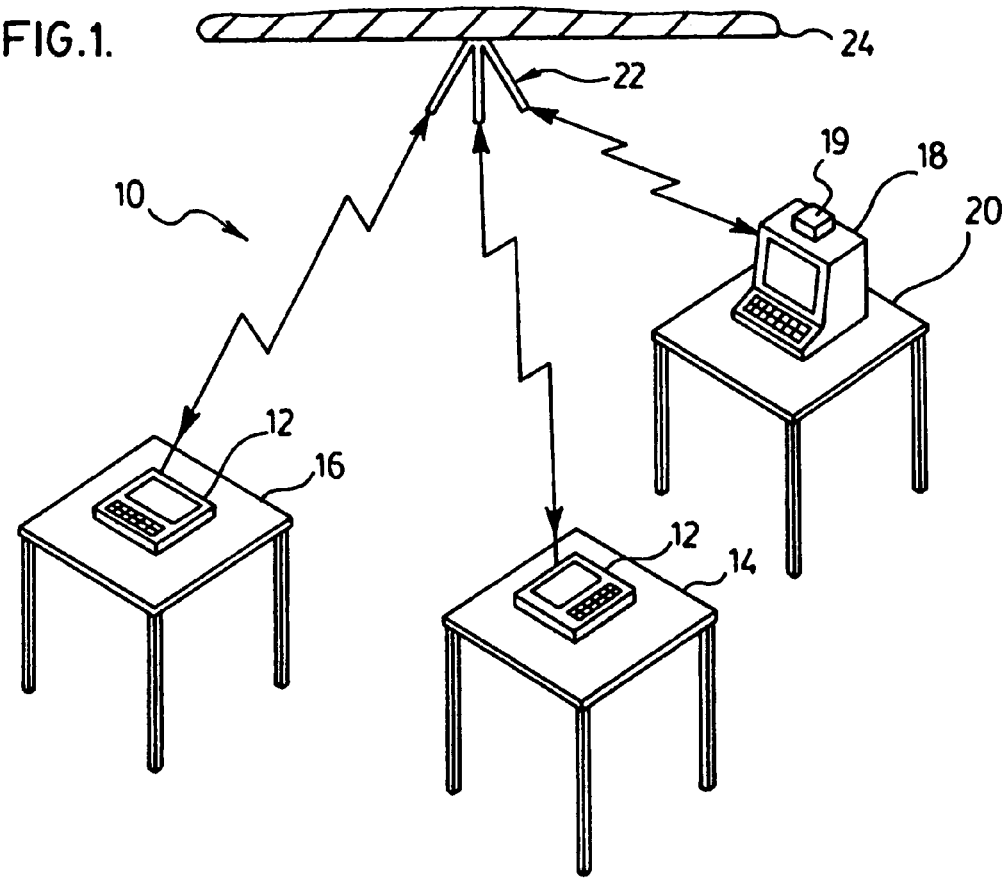
FIG. 1 is a perspective schematic view of a system or network constructed in accordance with the present invention.

FIG. 1 shows a card playing system or network 10 constructed in accordance with the present invention. The system includes a plurality of individual electronic remote input/output scoring units 12, one for each of a plurality of card tables 14, 16, etc. Only two tables and two scoring units 12 are shown in FIG. 1, but it should be understood that normally there would be a much larger number of tables, as there are in a typical bridge game at a bridge club or tournament. The chairs provided for the four players at each of the tables are not shown, for the sake of clarity in the drawings.

The system 10 also includes a base computer 18 at a base station such as a table 20. The base computer 18 is an ordinary personal computer loaded with software for computing scores, creating standings of players competing in a game, preparing movement schedules for players, etc. Such software is well known and in widespread use at the present time. A printer (not shown) is connected to the computer to provide print-outs of standings, results, etc.

An optional director or service call light 19 (also see FIG. 5) appears on or next to the computer 18.

Each of the remote scoring units 12 and the computer 18 contains a transceiver which enables the wireless communication of data from the scoring units 12 to the computer 18, and from the computer 18 to the units 12.

If desired, or needed, a simple antenna 22 is attached to the ceiling 24 of the room in which the game is being played and can be used to assist in the wireless communications. Otherwise, antennas which are provided within each of the remote units 12 and the computer 18 can be used along to provide wireless communications. Separate antennas maybe needed in large rooms, or where the base computer is in a different room, etc. The antennas can be attached to walls or other convenient structures, as well as to the ceiling.

Remote Input/Output Scoring Unit

Figure 2:
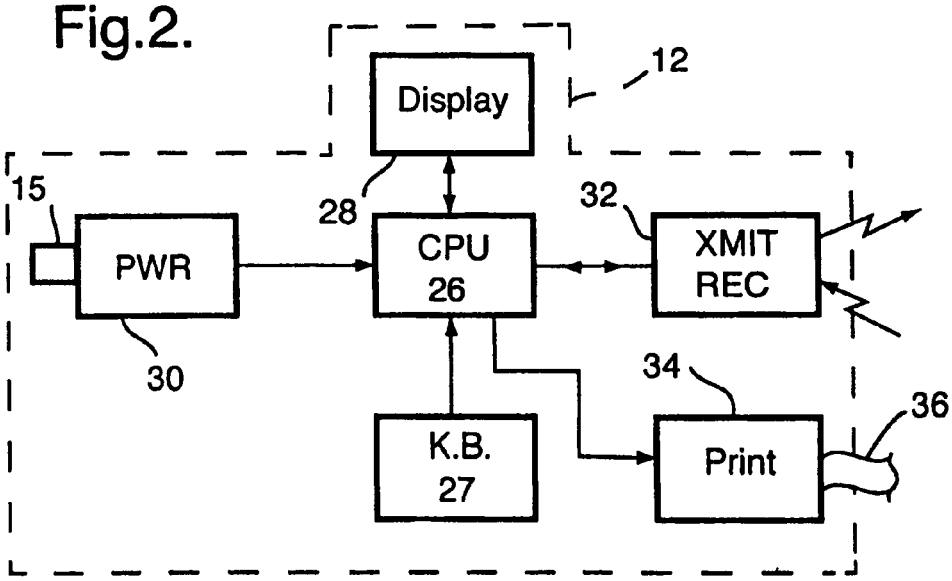
FIG. 2 is a schematic block diagram of one of the remote electronic input/output or scoring units of the system shown in FIG. 1.

FIG. 2 is a block diagram of the components contained in each of the scoring units 12. Each unit 12 includes a CPU 26 with a keypad 27, a display screen 28, and a power source 30, preferably including a rechargeable battery. ROM and RAM semiconductor memory is provided with the CPU, as needed. Additional memory may be provided, but it is believed that disc memory will not be necessary. Thus, savings of space and cost can be achieved.

A transceiver 32 with an integral antenna (not shown) is provided in order to send and receive radio signals representing playing and scoring information.

An optional printer 34 also can be provided to prepare a printed "traveler" 36 for each deal. However, it is preferred that the printer 34 be omitted, so as to save cost and space, and that the information usually provided on a printed traveler be stored by the base computer and transmitted to a scoring unit upon demand, when both pairs at the table from which the demand was sent have played the hand. The information then is displayed on the display screen 28. Instead, or in addition, the traveler's information for a given board can be displayed automatically, at the end of play of the board and after transmission of the results of the play or the hand.

Now referring to FIG. 3, the scoring unit 12 includes an outer case 13, whose vertical height or thickness can be small, as it is shown in FIG. 4.

The unit 12 is shown resting on a turntable 38 so that it can be rotated easily for access by successive players at the table.

Referring again to FIG. 3, the scoring unit 12 includes the display screen 28, which can be a liquid crystal, plasma or other display screen like those provided in laptop or palm computers. Preferably, the screen displays are in color, but a black and white display is a viable lower-cost option.

Various function buttons or devices are provided in addition, such as a power on/off button 42, a cursor control such as a track ball 44, a key 46 for summoning the director, a delete key 48, and an optional service call button 49 for summoning a waiter or other service personnel. A confirmation lamp 41 is provided to light whenever a message has been sent by the scoring unit and received at the base station, or vice-versa.

Other keys in the keypad 40, as well as the displays which appear on the display screen 28, will be described in the detailed description which follows.

Set-Up Procedure

Before the start of a duplicate bridge game for pairs, the director or other person stores in the base computer 18 the board numbers, and vulnerability of the pairs, and the dealer's position is stored for each board to be used in the game. This information is stored in the base computer 18, and in the memories of the remote input/output devices 12.

Because the vulnerability, board number and dealer's position usually are marked permanently on each board, this information may be stored in the base computer once and need not be re-entered for each game, for as long as the same boards are re-used.

Long term storage in each scoring device 12 can be achieved by the use of EEPROMs (electrically erasable programmable read-only memories) or the like to store the information. Such memories retain the data indefinitely, even if the battery in the unit is run down, until re-programming is needed because new boards must be identified.

The director or other person stores in the base computer the names and pair numbers for all pairs playing in the game. This information comes from the players who fill out information sheets, in advance, or is input by the players themselves, as it will be described below. The pair numbers usually are determined by the table number at which the players first sit at the start of the game. For example, the players starting play at table No. 4 become pair numbers N-S 4 and E-W 4, numbers which they typically retain throughout the game.

The number of boards to be played in a given round (usually from two to five boards) also is stored in the base computer. This information is transmitted to each scoring unit and stored. It is used to retain the same player numbers, without requiring re-entry, until the requisite number of boards has been played for that round. It also can be used to inhibit the sending of scores until all scores in a hand have been entered, in the embodiment of the invention in which the scores are stored in the memory of the remote unit until all are in, and then sent in a batch, to save battery drain.

Instead of the director or other personnel having to input the player identification information, it can be done by the players themselves, using the scoring units as input devices.

When a player first sits at one of the tables to start play, he or she should "sign in". This is done, in response to prompts, when the scoring unit is first turned on. The player inputs his or her position at the table (E, S, W or N) followed by the player's identification number, such as the unique ACBL (American Contract Bridge League) number which the player is assigned when joining that organization. Special identification numbers can be given to the very small minority of North American players who are not members of the ACBL. Outside of North America, similar numbers assigned by organizations like the ACBL can be used.

This information then is sent to the base computer which derives the name, address, etc., of the player and enters it for the preparation of standings, results and attribution of master points, and for other purposes.

The director or other operator sets up the base computer to send and receive information, and stores the number for each table, and sends that number to the receiver in the scoring unit for that table. The scoring unit stores the table number and uses it to identify all transmissions it sends during the game, and displays the table number prominently on its screen (see FIG. 3).

In other games for pairs, such as Swiss teams games, the procedure is the same, except that scoring is in terms of "IMPs", which are computed differently than for ordinary pairs games. Programs for such scoring are easily stored in the remote units.

In so-called "individual" games where players compete without partners but with a prearranged movement schedule, instead of printing movement schedules, the schedules can be displayed on the display of each remote input/output device upon demand.

The movement schedules for "individual" games and for "Howell" movement games for pairs can be derived by existing computer programs and uploaded for storage in the remote units 12 for recall at any time by the players so they can determine where to go next after finishing a round. Thus, it is possible, by use of this invention, to eliminate the need for printing and distributing movement schedules.

In calling up the movement schedule, the player number (for "individual" games) or the pair number is input and one of the existing keys can be programmed to be a "soft" key and can be pressed multiple times to display the schedule. Alternatively, a dedicated key or switch can be provided.

"Knockout" games and other "team" games for teams of four or more players also can be scored using the invention. The players report the scores of each hand played in the usual way described above, with scores being computed in IMPs by the remote scoring units 12. If preferred, the remote units themselves can be programmed to communicate the above functions without the use of a base computer.

Playing Procedure

A player at each table presses the power button 42 to power up the scoring unit 12 at that table.

After the players sign in, as described above, the information displayed on the screen now is the table number, followed by prompts instructing players to do the following to start play:

(a) Press "Pair" and either "E" or "W" or "N" or "S" and the Pair Number for each pair. The pair number usually is the table number of the table at which the pair first sits.

In "individual" games, each player enters his or her player no. and position, such as "9E".

(b) Press "Board No." and the number of the first board to be played (as shown in FIG. 9, the Board No. is printed on a label or etched on the board), and press "SEND" to transmit the information to the base computer.

The base computer can compare the pair number or player numbers for a pair or each individual arriving at the table with the pattern stored in the base computer before the start of the game. If the number of the pair or individual arriving at the table does not match the number of the pair or individual that is supposed to be arriving, a warning (e.g., flashing "seating error" message) appears on the screens of the base computer and the scoring unit, until a correction is made.

The vulnerability information for each board is transmitted from the base computer or stored in the remote unit and appears on the display 28 next to each player's position.

(c) Enter bids using input keys until a contract has been reached, as it will be described in detail below.

(d) When a contract has been reached, Press "play". The contract reached now is displayed. After a delay of, say, 5 to 15 seconds, the bids will disappear from the screen while the hand is being played to save power and minimize distraction and/or excessive exposure of the bidding to other nearby players;

(e) A prompt appears: "When the game is finished, press "Made" and enter the number of tricks made" (e.g., "3 spades"). When this is done, the scoring unit 12 then compares the number of tricks made with the number bid and computes the score and displays it.

(f) A prompt appears: "If the score is correct, press "send" to transmit the score." This causes the score, the player numbers and the Board No. to be transmitted to the base computer, which stores it.

Instead of transmitting the score of each hand to the base station immediately after the hand has been played, the scores can be stored in the remote unit and transmitted only when all of the boards have been played in a round. This can save battery power by minimizing the number of transmissions required from each remote unit per game.

(g) Then a prompt appears: "Enter new Board No.". A player does so, and the process is repeated until all of the boards have been played in the round, at which time a new E-W pair or set of individual players arrives at the table, as well as a new group of boards, and the playing and reporting process is repeated for a new round.

As noted above, the number of boards played in each round can be entered in the base computer and stored in each scoring unit at the beginning of each game. The scoring unit 12 is programmed to ensure that the player numbers need not be entered for any but the first board in the round; the numbers are automatically re-used for the subsequent boards in the round.

As noted above, rather than requiring the director or other person to enter the players' names for each new game, the players' names can be stored in a list stored permanently or just for the game in the base computer, together with a unique identification number (such as the ACBL number) identifying that player. Then, at the beginning of each new game, in response to a prompt appearing on the screen at each scoring unit 12, the player inputs his or her unique identification number, together with his or her pair number or player number for the game.

At some tournaments, pair numbers are assigned as the players pay their entry fees, and ACBL numbers must be given by the players. As noted above, the ACBL numbers and pair numbers can be input by the players using their scoring units 12 at the start of play, thus saving the tournament operating personnel from performing that task.

EXAMPLE

In the bidding and scoring example shown on the display 28 in FIG. 3, for a pairs duplicate game, South is the dealer, and he or she presses "S" and the "pass" button. A rectangular symbol 52 labeled "pass" (preferably green like the familiar "pass" bidding card) appears, indicating that South passes.

Then, West rotates the scoring unit 12 and uses the keys to enter "W" and "pass" to cause a "pass" symbol 54 to appear on the display.

Next, North rotates the unit 12 90° and presses "N", and the "1" key, and the club key to bid one club and cause a 1 club symbol 56 to appear.

Then, East rotates the unit 12 and presses "E" and the "1" key and the heart key to bid one heart, and a 1 heart symbol 58 appears on the display.

South then bids 1 spade, and the symbol 60 appears next to the "pass" symbol 52.

West then passes, and a second pass symbol 62 appears next to the first pass symbol 54.

Next, North generates a 2 no trump ("2N") symbol next to the 1 club symbol 56, thus bidding two no-trump.

Then, East passes, as indicated at 66.

Finally, South bids 3 no trump ("3N") as shown at 68, and West, North and East all pass, as shown at 70, 72 and 74, respectively.

Thus, a bidding sequence is displayed on the screen in a format very much like that displayed by the use of standard bidding cards, but without the need for the cumbersome bidding boxes or bidding cards.

If jump bids are made, the "stop" key is pressed before the bid to warn the other players. If desired, the unit 12 can be programmed to automatically detect jump bids and display a "STOP" symbol whenever one is detected. An algorithm is used to detect every bid which is higher than that necessary to overcome the prior bid, and to display the "STOP" symbol in response.

If the bid made must be "alerted" to the opposing pair, this is done by pressing the "Alert" key.

Warning symbols appear on the screen to indicate the "stop" and "alert" warnings.

As noted above, the bidding results and score from any deal is displayed for only a short time, e.g., 15 seconds, and then the program in the unit 12 erases the information from the display.

If one wishes to review the bidding, or the score, that information can be recalled for another short time by pressing the "Recall" key 40.

Double ("DBL") and redouble ("REDBL") keys are provided to enable one to double and redouble bids.

If trick penalties are awarded by the director (e.g., for reneging), any such penalty can be accounted for by subtracting or adding the appropriate number of tricks from or to the number of tricks made and reporting the resulting number by use of the "MADE" key.

As it was noted above, the display 28 preferably is disabled during play of a hand and at other times when it is not needed, in order to minimize power drain on the rechargeable batteries.

If desired, a "traveler" ticket 36 (FIGS. 2 and 3) can be printed after each hand to be folded and inserted into the board played to tell subsequent players how others did when they played the hand. However, the electronic method of providing the traveler information, described herein, is preferred.

The information regarding the bidding and results of each hand also can be transmitted to a scoreboard at events where such items are displayed to spectators. Transmission can be either from one of the scoring units directly, or from an antenna on the base computer.

Also, although it is preferred to use wireless transmission, because it allows a wide variety of table and base computer locations, transmission also can be by wire or fiber-optic lines.

Similarly, although battery power is preferred for each scoring unit, each unit also can be made to use ordinary household power by way of a cord plugged into a wall outlet or extension.

Standings

The base computer computes the standings of the players after each round. Any player can display the standings at any time by pressing the "STGS" key.

An example of the standings screen, as it would appear on the scoring unit screen, appears on the following page.

0-200 Pairs Monday Eve Session May 5, 2005
STANDINGS AFTER 3 OF 7 ROUNDS

| Pair | North-South Score | | Section A | Rank B | |
|---|---|---|---|---|---|
| 6 | 85.00 | A | 1 | | R. Smith - A. Epstein |
| 1 | 75.00 | A | 2 | | H. Loewy - B. Klein |
| 3 | 72.00 | B | 3 | 1 | — |
| 9 | 61.00 | A | 4 | | — |
| 5 | 60.50 | B | | 2 | — |
| 7 | 59.00 | A | | | — |
| 4 | 53.50 | B | | | — |
| 3 | 52.00 | A | | | — |
| 8 | 48.50 | B | | | — |

| Section Pair | East-West Score | | Section A | Rank B | |
|---|---|---|---|---|---|
| 7 | 75.50 | A | 1 | | M. Kenner - G. Edwards |
| 6 | 74.50 | A | 2 | | — |
| 2 | 68.50 | B | 3 | 1 | — |
| 8 | 66.00 | B | 4 | 2 | — |
| 4 | 63.00 | B | | | — |
| 5 | 63.00 | A | | | — |
| 3 | 57.00 | B | | | — |
| 1 | 55.50 | B | | | — |
| 9 | 44.00 | B | | | — |

This screen looks very much like the final standings printout printed out by the printer connected to the base computer, except that certain details are omitted, such as the master points awarded and the percent of the maximum possible score achieved by each pair.

The names of only some of the players are listed in the above screen. However, to save space, only the identification number of one or both members of each pair can be listed, instead of names, to potentially save even more space.

The notation "0-200 Pairs" identifies the game as a game for pairs of players, neither of which has more than 200 master points.

The section letters "A" and "B" give the rankings of players in each of the two strata, e.g., "A" for pairs in which one player has between 100 and 200 points, and "B" for pairs in which neither player has more than 100 points. There might be more strata, such as "A", "B" and "C".

Travelers Information

In order to provide information regarding the scores achieved by others who previously played a board, the base computer is programmed to retain this information for each board and send it to a specific scoring unit for display, in response to a request entered by pressing the combination of the board number and the "STGS" key. This causes the pair or player numbers of those playing at the table and the "STGS" signal to be transmitted to the base computer, or just the "STGS" signal if the pair numbers or player numbers already are stored there.

The base computer has stored the players' scores and pair numbers for those who have played the board. It first compares those pair numbers with the numbers of the players who have played the board. If and only if this comparison establishes that both pairs at the table have played the board, then the "traveler" information is displayed, preferably for only a limited time (e.g., 5 to 10 seconds). Preferably, this is permitted only after the pairs at the table have played at least one board so as to minimize chances that wrong pair numbers have been input, either deliberately or by accident.

An example of the travelers information which appears on the scoring unit screen is set forth below.

TRAVELERS INFORMATION
AFTER 5 OF 7 ROUNDS

| Board Number | Pair No. | PRIOR SCORES E-W | PRIOR SCORES N-S | Pair No. |
|---|---|---|---|---|
| 10 | 9 | 110 | −110 | 9 |
| | 7 | 400 | −400 | 8 |
| | 5 | −50 | 50 | 7 |
| | 3 | Pass | Pass | 6 |
| | 1 | 420 | −420 | 5 |
| 11 | 9 | 100 | −100 | 9 |
| | 7 | −450 | 450 | 8 |
| | 5 | −140 | 140 | 7 |
| | 3 | −450 | 450 | 6 |
| | 1 | −140 | 140 | 5 |
| 12 | | ACCESS DENIED | | |

In the above display, the top score achieved by an E-W pair, is highlighted for each board, as is the top score achieved by an N-S pair.

For example, Pair 1 had the top E-W score for Board 10, and Pair 7 had the top N-S score. Similarly, for Board 11, E-W pair 9 has the top score, and N-S pairs 8 and 6 were tied for the top N-S scores. It should be understood that these rankings can change as others play the board.

As it can be seen from the foregoing example, the travelers information can be requested for more than one prior board at a time. Although the information is given for Boards Nos. 10 and 11, "Access Denied" appears on the screen for Board No. 12 because one or both of the pairs at the table had not yet played that board.

This gives the players the information they want, without having to use paper "travelers". In addition, the system can provide such information much later in a game than paper travelers can. For example, for boards played early in the game, when the travelers information is sparse or non-existent, players can access the travelers information later, when the performances of other pairs on the board has been recorded, and the information is more nearly complete and informative.

Security

Security is maintained by encrypting information transmitted regarding the contract and score on each board, and changing the encryption key from time to time, so as to reduce the chances of the unwanted disclosure of information to competitors who have not yet played the boards.

Transmission Protocol

A data transmission protocol is used to be sure that no data is lost if there is simultaneous transmission from any two or more scoring units, or simultaneous transmission from one or more scoring units and the base computer.

Although a number of different communications protocols can be used, Bluetooth techniques are believed to be especially desirable. In particular, FHSS (Frequency Hopping Spread Spectrum) technology can be used to minimize the chances of interference between simultaneous transmissions.

Other protocols can be used, such as those provided by 802.11(b), 802.11(g), 802.11(a), or UWB standards. These will be described in greater detail below.

Bluetooth devices operate in the 2.45 GHz range of the unlicensed ISM (Industrial, Scientific and Medical) spectrum. Security is provided by encryption and authentication using the challenge-response technique.

It should be understood that this invention does not necessarily change the manner in which the playing cards are shuffled and dealt or otherwise arranged into four "hands" which are inserted into the four pockets of a board. It also does not necessarily change the way the hands are played and the cards arrayed to show tricks won and tricks lost, and then returned to the pockets in the boards, and the boards passed on to another table after being played.

Programming

The programming of each scoring unit 12 to compute the score of each hand is believed to be straightforward.

Preferably, several look-up tables are stored in memory which is part of or connected to the CPU. Each table stores a score corresponding to each specific result. For example, one table would store the scores for various bids made in either diamonds or clubs, both vulnerable and non-vulnerable. A separate table could provide the same information for spades or hearts, and another table for no-trump. Separate tables, or extensions of the original tables, can provide scores for bids with overtricks, doubled bids and re-doubled bids, etc.

Separate tables can be used for scoring the results of failed bids, vulnerable and non-vulnerable, doubled and re-doubled. The base computer is programmed to use the information for standard duplicate game scoring, "IMP" scoring and/or any other scoring system desired. Signals giving the selection of the scoring method to be used can be transmitted to the remote scoring units 12 at the start of the game.

The program also can include look-up tables or an algorithm to convert the "made" number into a form usable in the tables. The "made" number is compared with the "bid" number and either the identity, deficit or surplus is determined.

For example, if 3 spades is entered as the "made" number, and 4 spades was bid, then a table is addressed giving the score of "down one", at the vulnerability and doubling applicable, to display the result as a certain negative score; e.g., "−50" if non-vulnerable and not doubled, or "−200" if doubled and vulnerable. The negative score is entered for the pair who made the bid, and a positive score in the same amount is entered for the other pair.

These scores are sent to the base computer when the "send" key is pressed.

If all players pass and there is no contract, pressing the "made" key causes a "passed hand" legend to appear on the screen 28, and a score of zero for each pair is sent to the base computer 18 when the "send" key is pressed.

The base computer is programmed to accept and process the scores it receives from the remote units by wireless transmission or cable in the same way it would if they were input manually.

Errors

The scoring unit is programmed to reject any bid which is insufficient and show an "INSUFF" signal 50. The sufficiency or insufficiency also can be determined by means of a look-up table.

The director can be called to settle insufficient bid and other disputes by pressing the "DIR" button 46. This causes a colored light 19, (FIGS. 1 and 5) on or near the base computer 18 to light and flash and display the table number of the table requesting service. This is a convenience for both the director and the players, who need to shout less to get the director's attention. It also will keep the noise level down and reduce the distraction of the other players.

FIG. 5 shows the light unit 19 displaying the table number (e.g., "16") in large, bright letters. An ordinary IR (infrared) remote unit 94 such as those used to control TV's, radios and stereos, can be used by the director or other service personnel to turn off the light to acknowledge the signal. The unit 19 has its own radio receiver and infrared (IR) receiver to receive both the scoring unit and remote unit signals.

Alternatively, the remote unit 84 can transmit a RF signal which will not interfere with transmission between the base computer and the remote scoring units, and the transceiver in the base computer receives the RF signal and sends a signal to turn off the light 19.

Most preferably, each scoring unit 12 is programmed so that pressing it a second time turns off the signal light 19. This sends a second RF signal which is received in the base computer transceiver which sends a turn-off signal to the light 19.

Using this extinguishing arrangement allows the director to press the call button 48 when he or she arrives at the table making the call, thus assuring that the light 19 is not extinguished until the call is complete. This also allows the players at the table to extinguish the light if it has been pressed erroneously, or it becomes unnecessary to call the director due to settlement of the dispute without need of the director's assistance.

If multiple games are being played in different sections, for example, if Section A consists of tables in a game limited to players with 0 to 200 master points, and section B has tables in an "open" game (one in which the players can have an unlimited number of points), the tables typically will be numbered "A 15" or "B 12", for example.

Since each scoring unit is programmed initially with the number of the table, that number will be broadcast with each transmission, and the light 19 will show both the letter and number of the table making the call, despite the fact that the keyboard of the scoring unit is not a full alphanumeric keyboard and cannot be used to input the letter "A" or "B".

Another advantage of the call light 19 is that it informs the person called of exactly which table to go to, without hunting and further inquiry.

The same unit 19 or a different light unit can be used to indicate service calls, such as for equipment malfunction or food and beverage service by use of a different color of light. Alternatively, a differently-located light can be use instead. The call button 49 on the scoring unit 12, like the director call button 46, can be used to call for such other service.

In addition to, or instead of the light unit 19, which is cable-connected to the home computer, remote units with rechargeable batteries and self-contained RF receivers can be located anywhere in the room or rooms in which the game or games are being played.

For this purpose, unit 19 shown in FIG. 5 represents not only a display unit dependent upon the home computer both for RF signal reception, as well as power, and a stand-alone unit with its own batteries or wall plug and cord enabling remote use.

If a mistake was made in any entry, it can be corrected by use of a cursor 44 such as a "track ball" to select an item on the display 28 and delete it by pressing the "DEL" button 48. Alternatively, or in addition, "delete" and "backspace" keys are provided, as on a personal computer keyboard.

Alternative Keypad Arrays and Displays

Instead of the single keyboard and display shown in FIG. 3, either a mechanical keypad can be provided for each player, one on each of the four sides of the unit 12, or a single or four "virtual" keypads can be provided on a touch-screen.

An advantageous keypad and display construction is one which has only one keypad and display array which is made to rotate 90° or more to bring the keypad and display to a position facing a specific player. This construction is shown in FIG. 7.

This is accomplished by providing a scoring unit 80 with a "virtual" keypad 82 and display 84 in which the keypad comprises separate areas on a touch-screen, and the display area is immediately above it.

This arrangement is made to effectively rotate by 90° or 180° or 270° clockwise to place the arrangement in front of a specific player. This is accomplished automatically, in response to pressing the "E", "W", "N" or "S" key, by rotating the array to the corresponding position.

Thus, if the array is rotated 90° clockwise, the keyboard array is rotated to the position shown by dashed line 86 and the display occupies the area indicated by reference numeral 88, and so forth.

Another alternative scoring device 89 is shown in FIG. 6. The display can be a simple two or three-line text display 90 with a keypad 92. The display 90 displays in sequence, the starting information, bidding information and results, in alphanumeric characters instead of the graphic form provided in the FIG. 3 embodiment information. Standings and "traveler" information can be reported in the same way. This could reduce the cost of each scoring unit by a substantial amount.

In the bidding example shown in FIG. 3 and described above, the display 90 of the FIG. 6 embodiment shows the final bid of 3 no-trump, as well as most of the prior bids, in a descending sequence with the oldest bids last or gone. The bids are erased in a FIFO sequence, but can be recalled, upon demand.

One further possible modification of the keyboard of the scoring unit is the addition of more keys to permit the functions permitted by standard keyboards of lap-top computers, such as scrolling up or down, typing alphabetic characters, etc. However, various methods can be used to avoid having to do this. For example, in order to avoid the need for scrolling to show standings, the standings can be divided to show E-W standings on one screen and N-S standings on another. Other measures used to avoid the extra space and cost of using a full alphanumeric keyboard are described elsewhere herein.

Docking

It is preferred that a "docking" station be provided in an enclosure that can be locked while the scoring units are stored inside. The docking station has a powered terminal for each scoring unit 12 with a plug which plugs into a receptacle 15 (FIG. 4) to recharge the rechargeable battery 30 overnight, or during other periods of non-use, in preparation for later use.

Figure 12:
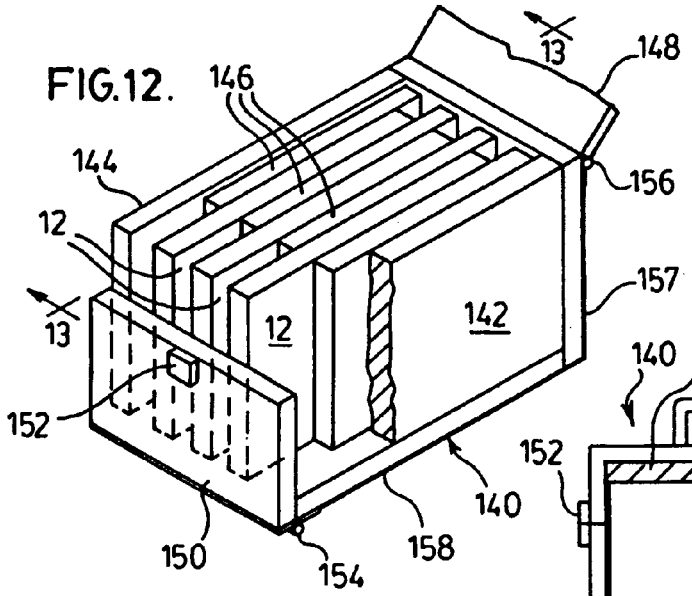
FIG. 12 is a perspective, partially broken-away and schematic view of a storage and carrying case and recharging unit for rechargeable batteries in the scoring units.
Figure 13:
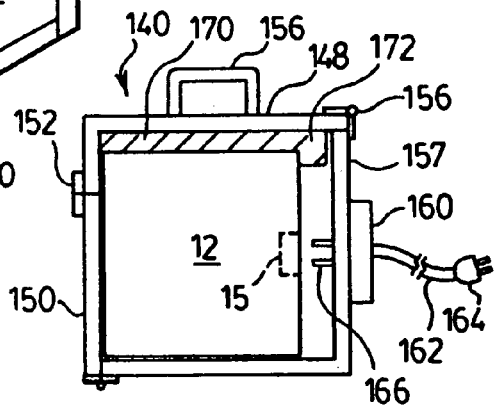
FIGS. 13 and 14 are cross-sectional views taken along line 13-13 of FIG. 12.
Figure 14:
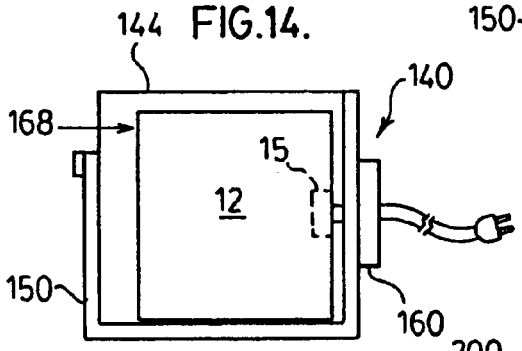

FIGS. 12-14 show a carrying storage and docking case 140 for scoring units 12.

The case 140 has side walls 144, 142, a bottom wall 158, a rear wall 157, a hinged front wall 150, and a hinged cover 148.

Three scoring units are shown stored on edge in three compartments formed by partitions 146, which are shorter in length from front to back than side walls 142 and 144. A key-lockable latch 152 is provided to latch the cover 148 to the front wall 150. The cover 148 has a carrying handle 156.

As it is shown in FIG. 13, secured to the rear wall 157 is a power converter box 160, a cord 162 and a plug 164 to plug into an ordinary household electrical power outlet. The converter box 160 converts the 60 Hertz, 120 volt household current into D.C. or other form needed to recharge the rechargeable batteries in the scoring units. A set of terminals 166 protrude through the rear wall 157 and into the case 140 for each of the three compartments, at a location in which the terminals 166 are aligned with the holes in the receptacle 16 in each scoring unit 12.

When the scoring units 12 are inserted into the case 140, the cover 148 is pivoted about a hinge 156 and raised, as shown in FIG. 12, and, if desired, the front wall 150 is pivoted downwardly about hinge 154 out of the way.

When the scoring units are being carried, preferably, they are disconnected from the terminals 166 to prevent damage to the terminals or the receptacles 15. Therefore, the units 12 are in the far forward position shown in FIGS. 12 and 13. In addition, protective members 170 and 172 secured to the surface of the cover 148 (not shown in FIGS. 12 and 14) are made of foam rubber or the like make contact with the upper edges and inward edges of the units 12 to hold them in place and prevent them from moving in the case and being damaged.

When it is desired to plug the units in to recharge their batteries, the cover 148 is raised and the units 12 are pushed to the right, in the direction of the arrow 168 shown in FIG. 14 to engage the receptacles 15 with the terminals to recharge the batteries.

When the units 12 are to be used, they are disengaged from the terminals 166 and carried to the desired location.

Figure 15:
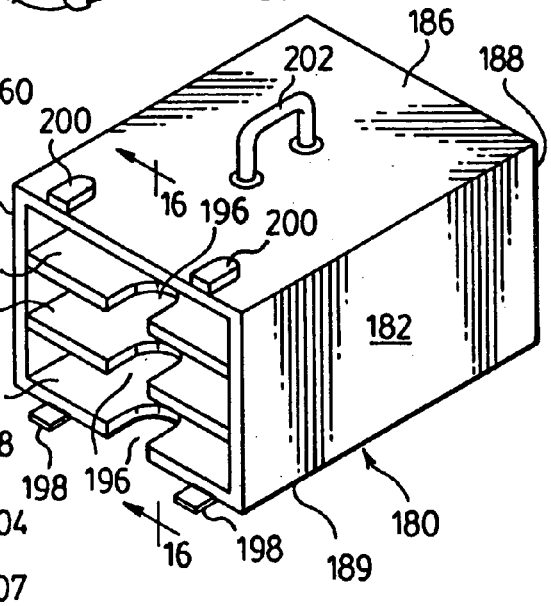
FIG. 15 is a perspective view of another storage and carrying case and docking unit for scoring units.
Figure 16:
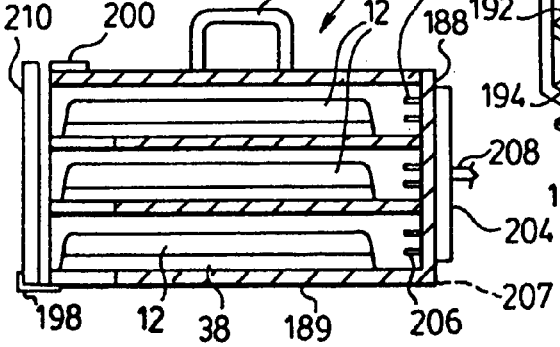
FIG. 16 is a cross-sectional view taken along line 16-16 of FIG. 15.

FIGS. 15 and 16 show an alternative carrying, storage and docking case 180. The case 180 has side walls 182, 184, bottom and top walls 189 and 186, respectively, a rear wall 188, and a removable cover 210 held by lockable fasteners 198 and 200. A carrying handle 202 also is provided.

The interior of the case is divided into three compartments 190, 192 and 194, each sized to receive one of the scoring units in a horizontal orientation.

A power converter 204 with a cord 208 is mounted on the rear wall 188, and has a pair of terminals 206 extending into each compartment at a location aligned with the receptacle 15 in each scoring unit.

When the scoring units 12 (with or without turntables 38) are inserted into the compartments, they are located away from the terminals for carrying. If desired, foam cushions can be located at the rear of each unit 12 to keep it immobile during carrying.

When the units are to be recharged, they are pushed back into the case until the terminals 206 enter the receptacle 15. The U-shaped cutouts 196 in the horizontal walls of the case facilitate pushing the units 12 into contact with the terminals 206 and pulling them away.

If desired, the rear walls can be hinged as at 207 and latched at the top edge to facilitate insertion or removal of foam cushioning in the rear portions of the compartments, and to facilitate moving the units 12 into and out of the case.

The horizontal orientation of the scoring units 12 during carrying and storage may be preferred in that it may reduce the effects of jarring of the units during transport.

The cases 140 and 180 shown in FIGS. 12-16 can be used to carry the scoring units in clubs, where they can be put into a lockable room or other enclosure, or they can be used for transport of the units to a variety of tournament locations.

If desired, in a more permanent installation, the docking structure shown in FIGS. 12-16 can be installed in storage shelves instead of carrying cases.

For this purpose, the case bottom walls and the horizontal surfaces 190, 192, 194 can be considered to be shelves, and the terminals 166, 206 can be considered to be recharging terminals mounted at the rear of the shelves.

Alternative Power and Communications

Although it is believed to be advantageous to use rechargeable batteries as power supplies in the scoring units, it may be more cost-effective to use standard household A.C. instead. In this case, a power outlet would be provided at each card table, and each unit would be plugged into the outlet, and would have a suitable converter in the unit to convert the A.C. into D.C. and/or other forms needed to power the unit. This can reduce the cost and size of the scoring units.

Power distribution cords or cables can be laid in channels under the floor to the tables, if the floor space is dedicated to use as a card room, as it may be in a club or casino, for example.

Wireless communications are believed to be advantageous. However, if fiber optic or other cable can be provided between each card table and the base computer or other locations, at a cost reasonable under the circumstances, communications also can be through cables. This also can reduce cost and size of the remote scoring units 12.

Alternative Networks

Although it is believed to be advantageous to form a network of scoring units communicating with one or more base computers, it can be advantageous to use other types of networks.

Figure 17:
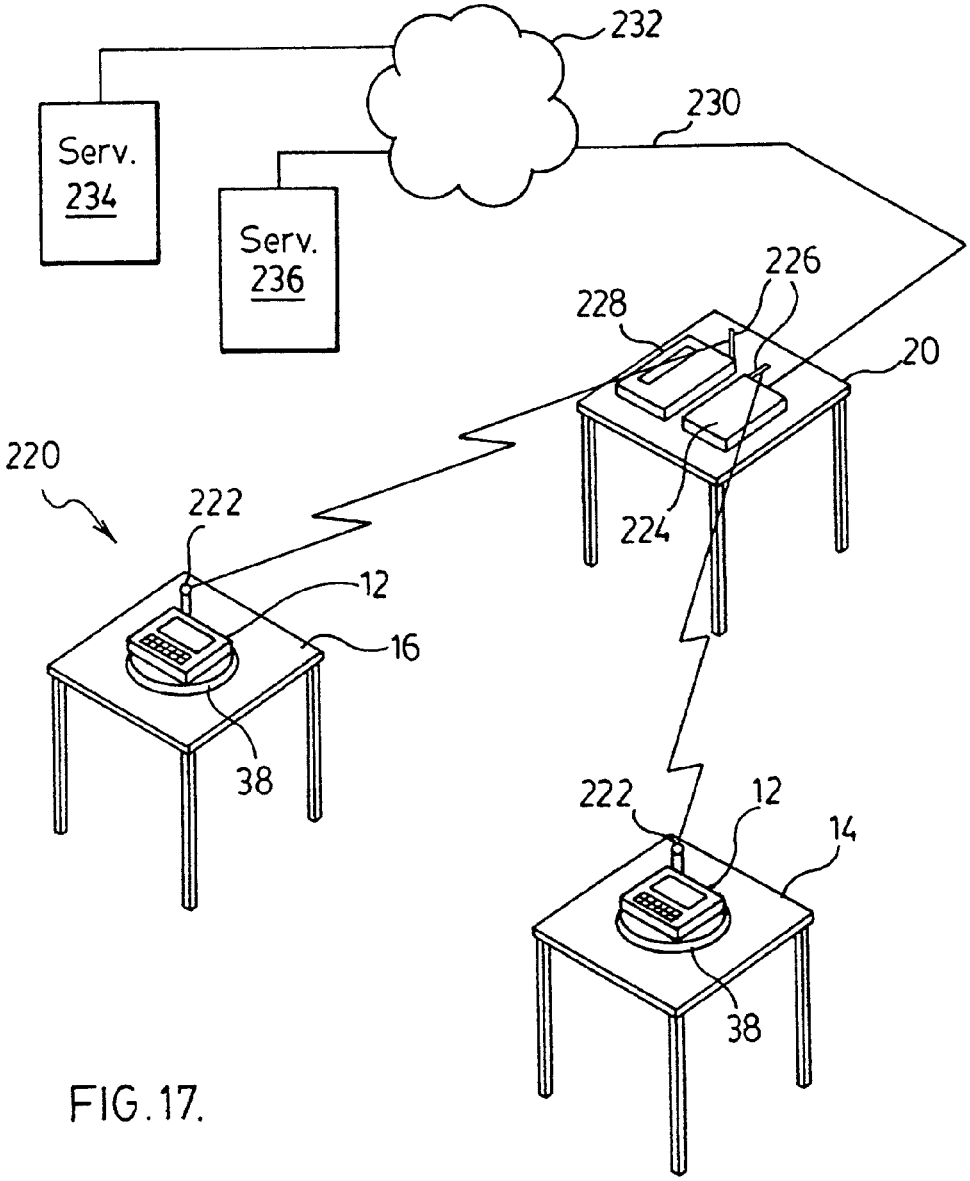
FIG. 17 is a perspective schematic view of another embodiment of the invention.
Figure 18:
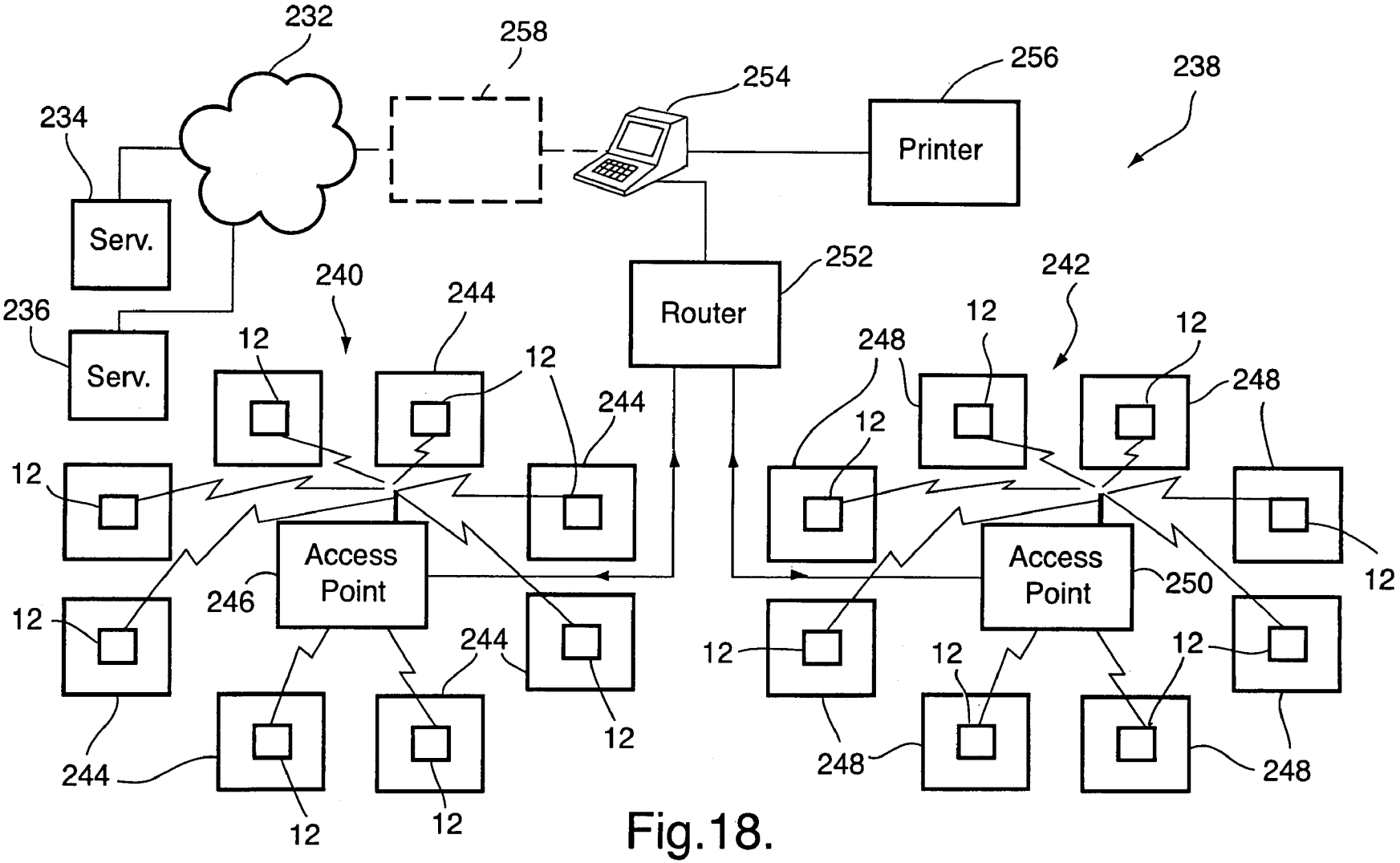
FIG. 18 is a schematic, partially perspective view of a further embodiment of the invention.

One alternative, shown in FIGS. 17 and 18, is to use the World Wide Web 232 to form a network with each scoring unit 12 being connected to the network either by wireless or cable connections.

A website on one or more servers 234 or 236 can be located anywhere in the World Wide Web. It can be used in place of or in addition to the base computer 18 described hereinabove to compute and deliver standings, travelers information, etc., as well as all other information needed to run a bridge club or tournament.

FIG. 17 shows a card playing network, particularly well-suited for playing bridge, having no base computer, but using a router 223 with one or more antennas 226, and an "access point" 224 which, as it is well-known, has a transceiver for transmitting information to the scoring units 12, which are remote input/output devices.

The router 224 is well known for use in Wi-Fi systems, and includes a modem (not shown) for connection through a line 230, such as a DSL or other high-speed access line to the World Wide Web 232.

Each of the units 12 has a Wi-Fi circuit card and an optional supplemental antenna 222 to enhance communications with the router.

The network 220 can use Bluetooth Standard, or any of the known Wi-Fi standards for communications, such as 802.11 (b) or 802.11(g) or 802.11(a), each of which usually has greater range than Bluetooth. 802.11(g) currently is preferred, but Bluetooth or new standards such as "UWB" (Ultra Wide Band) can be used instead, depending on the need for speed versus cost, etc.

An optional printer 228 with an interface (not shown) is connected to the router 224 to give print-outs of final results or other information desired to be in printed form. Of course, final standings, as well as interim standings can be displayed on each of the displays of the units 12 so that the players can see these results quickly and easily, without a printed copy.

The servers 234 and 236 are for maintenance of a web site containing software and computer equipment to develop the standings, travelers, player location, and other information noted above for each of a large number of games being played simultaneously.

One of the servers can be one maintained by a central governing organization such as the ACBL, which receives scoring and player information, computes master points, and provides other information to the clubs and tournament locations when accessed.

FIG. 18 shows a network 238, which is one of several different network configurations which can be used in the invention.

The network 238 includes two separate groups of input/output units 12, group 240 and group 242. These separate groups can be located in separate rooms in a hotel set up for a tournament, or in two other widely separated locations. In either case, wireless transmission between the units 12 and a single access point like the one in the router of FIG. 17 may be impossible or impractical.

Each group 240 and 242 has its own access point 246 or 250 to receive RF transmissions from and transmit RF signals to the units 12 in its group.

The outputs of the access points 246 and 250 are sent to a router 242, either by cable or wireless, which sends the signals to and receives signals from the base computer 254.

The connection of computers 254 to the World Wide Web is optional, and a modem 258 is shown in dashed lines for the purpose. Otherwise, the computer 254 can be used in a manner like the base computer 18 is used.

The networks shown in FIGS. 17 and 18 have the further advantage that they use electronic components, such as access points, routers, antennas, etc., that already exist for use in conventional Wi-Fi systems and can be relatively inexpensive. Also, existing communication protocols used in such systems already are available and can simplify the structure of the units 12.

Another embodiment of the network of the invention, which also is represented by FIG. 18, is one in which all of the remote units 12 are part of a network in which, after initially being loaded with software, they communicate only with one another until a game is complete. Each unit has all the software it needs to compute the scores of hands, standings, and travelers information.

Each unit transmits to every other unit, at the end of each round, the scores of the hands played using the unit, and each unit computes the standings, master points, etc., when all scores for a round have been received, and displays the standings, on demand. All such information accumulated during a game is stored and down-loaded to a base station computer only once, or only a limited number of times, thus saving battery power.

This embodiment may require that the remote units have a greater data storage capacity than some of the other embodiments, but it may be preferable, under some circumstances, if it reduces battery drain or minimizes signal transmission difficulties.

Use of the World Wide Web 232 makes it possible to conduct bridge games, and particularly tournaments, with improved ease of participation, attendance and play.

For example, the website for the tournament can provide means for advance enrollment by players coming from near or far away. On-line payment in advance can be made. This provides improved predictability of attendance.

Such advance enrollment can be attractive to the prospective players in that they can be assured of sitting either E-W or N-S, as desired, and do not have to wait in long lines to register at major events.

One added benefit of advance enrollment is that the names, identification numbers, etc., for the advance enrollees already are stored before the event, thus saving time needed to enroll last-minute registrants.

Discounts can be offered to advance enrollees to encourage advance enrollment and improve attendance.

Automatic Position Detection

FIGS. 8, 8A and 8B show a further embodiment of the turntable 38 used with the scoring unit 12. A detent structure is provided to let the players feel when the unit 12 has been rotated to a proper stopping position. Four recessed permanent magnets or LEDs 41, 43, 45 and 47 are used, one for each detent position. As shown in FIG. 8A, a detector 49 extends downwardly from the underside of the upper plate 51 of the turntable on which the scoring unit 12 rests. The detector 49 is a Hall Effect or other known magnetic detector which produces an electrical signal when brought into close proximity with a magnet, or a light (LED) detector to detect the light from the LED and produce a responsive signal. Whenever the detector 49 drops into one of the recesses, it is actuated by the magnet or LED therein, and also produces a "click" to let the players know it is properly positioned.

Item 53 of FIG. 8 is the ball race and ball bearings on which the upper plate 51 of the turntable rests and rotates. FIG. 8B is a cross-sectional view, partially schematic, which shows that the turntable 38 has a housing with an angled circular vertical side-wall 55, a horizontal support platform 57 secured to the side wall, with the ball race 53 supporting the plate 51 on which the scoring unit 12 rests. The turntable body preferably is injection-molded from ABS or other suitable thermoplastic material.

The operation of the detector 49 when it reaches the "S" position sends a signal to the scoring unit representing "S", the south position. This signal is used as part of any bid or other input requiring such a signal, without having to be keyed in by the south player. The same function is performed by the magnets or LEDs at the other 3 position, except that the signal developed at each location uniquely represents the N, W or E position.

This feature makes bid entry, signing in and other input tasks easier and quicker.

With this modification in use, each of the four sides of the scoring unit 12 should be marked with one of the N, S, E or W letters, as shown at 59 and 61, so that the unit 12 can be positioned correctly with respect to the N, S, E and W players.

"All Pass" Function

In another modification, bidding is facilitated by the provision of an "All Pass" key or function on the keyboard of the scoring unit 12. This need not be a separate key, but may instead constitute, simply, programming which treats three successive strokes of the "PASS" key, without rotation of the scoring unit, as completion of the bidding.

Board Storage

When the remote unit occupies the center of the playing table, there might not be adequate room to locate the empty board being played, or the other boards played during a round.

FIGS. 19 and 20 show a modification of the turntable 38 which provides space underneath the remote unit 12 for storing the boards while not in use.

FIG. 19 shows cut-out area 260 in one side of the base of the turntable 38. The cut-out is large enough to store one board 100 or more.

FIG. 20 shows a preferred construction with two passageways 268 and 270 tall enough to accommodate up to three boards each in stacks 278 and 280. The card table top is indicated at 282. Each passageway 268, 270 has a pair of opposed vertical side walls (not shown) to ensure that the boards slide into and out of the passageways smoothly.

Preferably, a corner or end of each board protrudes from under the turntable to make it easy to grasp one or all of the boards for removal.

Alarms

A multiple-purpose alarm (not shown) optionally is provided inside of each remote input/output unit 12. The alarm is connected to the antenna of the unit 12 and samples all signals transmitted to it or any of the other units 12 in its vicinity, and measures the signal strength it receives.

If the signal strength is above a pre-determined level, the alarm does not operate. If the signal strength dips below that level, this is an indication that either the unit is too far from the base station and must be moved closer, or that there is some other interference with transmission.

Preferably, the alarm emits a loud sound and/or lights a lamp. It is enabled by a RF enabling signal sent by the base station after the remote units 12 have been deployed at the start of a game, and before any of the units 12 is turned on. The enabling signal is extinguished when the base station is disabled after the end of play.

The alarm serves a further function—that of a theft deterrent. If one of the units is carried off, when it is only slightly beyond range of the base station, its alarm will sound and notify personnel that a possible theft is being attempted.

The same alarm or a different one can be provided to sound and/or flash a light to indicate that the rechargeable battery is low and should be recharged soon.

Other Card Games

The invention can be used to advantage in other card games, such as poker and other card game tournaments, where the remote input/output units can be used at separate tables to input bets and keep a running total of the amount of the pot, the size of "all-in" bets, and the amount of money or chips each player has on the table, with a base station recording results, standings, player locations, etc., thus speeding play and enhancing enjoyment.

Similar advantages can be obtained by using the invention in other card games, especially those involving betting and/or bidding, and multiple playing tables. Such other games can include hearts, spades, euchre, etc.

The foregoing features of the invention are further described as follows:

1. A bridge playing system comprising, in combination, a plurality of electronic scoring units, each being located on a card playing support surface, and a base computer adapted to receive scoring information from said scoring units and to transmit bridge game information to said scoring units by wireless transmission, each of said scoring units having a bridge game information indicating device and a transceiver for wireless communication of bridge game information with said base computer.

2. A system as in paragraph 1 in which each of said scoring units includes means for displaying the winning bid, and the number of tricks, taken, for entering bids, and for computing the score attained for each hand played.

3. A system as in paragraph 1 in which said base computer is programmed to determine the standings of players during said game and transmit information to said electronic scoring units for display of said standings on said scoring units.

4. A system as in paragraph 1 in which said scoring unit is programmed by signals from said base computer, to store the board number of each of a plurality of different boards being played in said game, and to store the vulnerability of each player of each board, and to compute the score of the play of each board.

5. A system as in paragraph 4 in which said base computer is programmed to store the number of boards to be played per round, and send signals to each of said scoring units for causing said scoring units to retain the pair number information and re-use said information for each board in a round.

6. A system as in paragraph 1 in which each of said scoring units has a signaling device for causing the transmission of service call signals, and including a visual signaling device for indicating the need for service and the identification of the table from which the call is made.

7. A system as in paragraph 1 in which each of said scoring units has a touch-screen keypad and a display for displaying information.

8. A system as in paragraph 7 system in which said touch-screen keypad and display are electronically rotatable to at least four different positions at which players can face and operate said scoring unit.

9. A system as in paragraph 1 in which said scoring unit has a keypad and a multi-line text display for displaying said bridge game information.

10. A system as in paragraph 1 in which said scoring unit has a display screen and a keypad with keys for entering bids, winning contract information, tricks made, sending bids and scores, and sending player identification information.

11. A card game playing input/output device comprising:

a housing, a visible information display on said housing, a computer comprising a CPU and memory in said housing, entry means on said housing for manual entry of information regarding said card game, said computer being programmed to calculate information about said game in response to said manual entry and display said information on said display, and transmitting and receiving equipment for transmitting information to and receiving information from a base station and displaying on said display information received from said base station.

12. A system as in paragraph 11 in which said entry means includes a turntable upon which said housing rests.

13. A device as in paragraph 12 as in paragraph 12 in which said turntable has a detent mechanism to indicate the proper positioning of said entry means, and for registering each successive position.

14. A device as in paragraph 13 in which said entry means includes means for entering the position of each player making a bid, and utilizing a signal generated by said detent mechanism to supply the position number of each player automatically, without need for entry by said player.

15. A device as in paragraph 11 in which said card game is selected from the group consisting of; bridge; poker; hearts; spades; euchre.

16. A device as in paragraph 11 in which said transmitting and receiving equipment is wireless, and including a low signal strength alarm to indicate the condition in which the signal strength received by said receiver is below a pre-determined level.

17. A method for scoring bridge games played at a plurality of tables by plural players, said method comprising providing a network including a plurality of remote input/output devices, one at each of said tables, entering scoring information from each game played at a table into an electronic device at said table, said device having a computer, a transmitter/receiver, and a display, transmitting said information to another device having another computer and another transmitter/receiver, processing and storing said information in one of said computers, and displaying bridge game information on demand on any of said electronic devices.

18. A method as in paragraph 17 including entering bidding and scoring information into each of said electronic devices at each of said tables, and sending said information wirelessly to a base computer, said bidding information including; the final contract and the players winning the bid; the board number played; the scoring information including the number of tricks taken and the score achieved and the player(s) who achieved the score.

19. A method as in paragraph 17 in which each of said devices at said tables is programmed to detect and indicate an input selected from the group consisting of: an insufficient bid; a jump bid; player sign-in; and an erroneous player location.

20. A method of using a card playing network comprising (a) setting up and maintaining a website, (b) setting up at least one bridge-playing site comprising a plurality of remote electronic input/output units, one at each of a plurality of playing tables, each of said units having a transceiver for communicating with a base station with transceiver antenna for delivering scoring information and receiving and displaying other information, (c) supplying interim standings information through said base station for broadcast to and display by said remote input/out units.

21. A method as in paragraph 20 in which said setting up and maintaining steps are taken well prior to a scheduled card game tournament, and allowing entrants to pre-register for said tournament on-line.

22. A method as in paragraph 20 including allowing said entrants to pay in advance their entry fees, and make accommodation and travel reservations through said website.

23. A method of conducting a bridge game using a system including a plurality of remote input/output devices, each having data processing equipment, including data storage and retrieval means, each being adapted to operation at one of a plurality of playing locations, a base station having means for transmitting information to an receiving information from said remote input/output devices, storage and retrieval means connected to supply and receive data at said base station, the steps of (a) storing in said remote input/output devices the identification of the boards to be played in said game, (b) storing in each of said remote input/output devices information indicating the playing location of said input/output device during said game, (c) inputting to each of said input/output devices the identification of each player using said device, (d) transmitting the player identification information to said base station.

24. A method as in paragraph 23 including the steps of storing information indicating the desired location of each player at a predetermined stage of said game, comparing said player identification information with said desired location information, and indicating any difference between said desired location information and actual information transmitted.

25. A method as in paragraph 23 including the step of transmitting starting information to each of said remote input/output units and, by means of said input/output units, communicating that information to the players at each table.

26. A method as in paragraph 24 in which said starting information includes at least one pre-generated set of bridge hands into which the players are to arrange a deck of cards.

27. A method as in paragraph 24 in which said starting information includes instructions as to where players and boards are to move during the play of said game.

28. A method as in paragraph 24 including the step of transmitting information regarding table skips or sit-outs to each of said remote input/output units and, by means of said input/output units, communicating that information to the players at each table.

29. A method as in paragraph 24 including the steps of storing the desired location of each board during each round, inputting to each of said remote input/output units the identification of each board to be played at the table at which said unit is located, and comparing that identification with the board numbers stored for that table in that round and indicating an error has occurred if the board identification does not match one of the board identifications scheduled to be played during that round.

30. A method as in paragraph 24 including the step of entering the identification of a player into the input/output unit at a table at which the player takes a new playing position, identifying the entering step as the start of a new round, comparing the identifications and positions of the players at a table with stored information regarding desired positions of players, and indicating the occurrence of an error if there is a deviation of any of the actual positions from the desired positions.

31. A card game playing network comprising a plurality of spaced-apart input/output devices, each having a housing, computer means in said housing, a display on said housing, and a device for transmitting and receiving information regarding said game, each of said input/output devices being arranged in a network in common with the other of said input/output devices, each of said input/output devices being adapted to receive input information from players of said game who use said input/output device, send scores achieved by said players to each other of said input/output devices, and to use said scores to compute the results of said game.

The above description of the invention is intended to be illustrative and not limiting. Various changes or modifications in the embodiments described may occur to those skilled in the art. These can be made without departing from the spirit or scope of the invention.

The invention claimed is:

1. A bridge game playing network using manually manipulable playing cards and comprising a plurality of adjacent but spaced-apart separate card-playing support surfaces in a room of a building, each of said support surfaces being adapted to allow a plurality of players to play cards at said support surface, a base station remote from each of said support surfaces, a plurality of remote input/output devices, each of said input/output devices being remote from said base station and spaced apart from the others and being located on a different one of said support surfaces and including an input device for inputting data relating to bridge games played using said cards at the location of said input/output device, a transmitter for transmitting data to said base station, and a receiver for receiving data transmitted from said base station, each of said remote input/output devices having structure and programming for electronic bidding and scoring, and being usable sequentially by each of said plurality of players at said support surface to enter bidding and scoring information, said base station having a network transmitter for sending information regarding said game to said remote input/output devices, and a network receiver for receiving bidding and scoring data transmitted from said remote input/output devices.

2. A network as in claim 1 in which said base station is selected from the group consisting of (a) a computer programmed to compute the standings of the players of bridge games played at said support surfaces and (b) a device for communicating between said remote input/output devices and the World Wide Web to obtain said standings, and said transmitter of said base station is adapted to selectively transmit said standings to said remote input/output devices.

3. A network as in claim 1 in which each of said support surfaces is on an individual table and said transmitters and receivers are wireless transmitters and receivers, and said input/output device occupies less than the whole area on said card table surface to leave areas for the players to place the cards they have played, and said input/output device is rotatable to be usable successively by each of a plurality of players located around said table.

4. A network as in claim 1 in which said transmitter and said receiver in each of said remote input/output units and at said base station is wireless, and said base station has equipment selected from the group consisting of:

(a) an access point;

(b) an access point and a router and a modem for connection to the World Wide Web; and (c) a combination of a pre-programmed general purpose digital computer with an access point and a modem for connection to the World Wide Web.

5. A network as in claim 1 in which said input device in each of said remote input/output devices is adapted for use in entering bids from each of a plurality of players located at the support surface bearing said remote input/output device, and includes a computing device for registering and storing the winning bid and the contract made, and for computing the resulting score, and an output device for using said transmitter in said input/output device for sending at least said score to said base station.

6. A network as in claim 1 in which said base station is adapted to transmit to each of said input/output devices the results previously achieved by others in playing a specified hand, but only upon inquiry by players who have played said selected hand.

7. A network as in claim 1 in which said network includes a plurality of sub-networks, each having an access point for receiving and sending information wirelessly from and to input/output devices within said sub-network, and being in communication with said base station.

8. A network as in claim 1 in which each of said input/output devices includes an electronic computing device programmed to detect and indicate a condition selected from the group consisting of:

(a) an insufficient bid; and (b) a jump bid.

9. A network as claimed in claim 1 in which said base station is adapted to supply bridge information to said remote input/output devices in the form of signals indicating information selected from the group consisting of:

(a) board numbers to be played;

(b) vulnerability of the players playing each board; and (c) identification of players to be present at a table during each round.

10. A network as in claim 1 in which said base station is adapted to supply bridge information to said remote input/output devices in the form of signals indicating information selected from the group consisting of:

(a) table skip instructions;

(b) computer-generated hands to be prepared by the players;

(c) movement patterns to be executed by the players between rounds; and (d) sit-out instructions.

11. A bridge game playing input/output device comprising:

a housing, a visible information display on said housing, a computer comprising a CPU and memory in said housing, said input/output device having a single entry keyset and a single display in said housing for manual entry of information regarding bidding and scoring in said bridge game, said keyset and said display both being rotatable together to different positions to facilitate entry of information sequentially by different players at multiple positions spaced around said input/output device, said computer being programmed to calculate scoring information about said game in response to said manual entry and to display said information on said display, and network transmitting and receiving equipment for transmitting information to and receiving information from a remote station selected from the group consisting of:

(a) another input/output device and (b) a dedicated base station, for displaying on said display information received from said remote station.

12. A device as in claim 11 in which said information displayed on said display includes the current standings of multiple players in said game relative to one another.

13. A device as in claim 11 in which said input/output device includes a touch-screen keyboard rotatable electronically to different positions on said visible information display.

14. A device as in claim 11 including a turntable upon which said housing rests.

15. A device as in claim 12 in which said input/output device is adapted to record and display information from the group consisting of;

(a) successive bids by each of a plurality of players;

(b) the winning bid;

(c) the number of tricks won in the play of a hand;

(d) the scores of the players of each hand;

(e) the identification of the table at which the hand is played;

(f) the prior scores of others achieved in playing each hand;

(g) identification of the players; and (h) the vulnerability of said players in playing the hand.

16. A device as in claim 14 in which said turntable has storage openings adapted to receive and store boards for holding duplicate bridge hands.

* * * * *